US010350909B2

(12) United States Patent
Tamai et al.

(10) Patent No.: US 10,350,909 B2
(45) Date of Patent: Jul. 16, 2019

(54) DECURLING DEVICE AND INKJET RECORDING APPARATUS

(71) Applicant: KYOCERA Document Solutions Inc., Osaka (JP)

(72) Inventors: Hiroatsu Tamai, Osaka (JP); Takeshi Watanabe, Osaka (JP); Hiroyuki Ueda, Osaka (JP); Noriaki Ozawa, Osaka (JP); Toyotsune Inoue, Osaka (JP); Susumu Hiroshima, Osaka (JP); Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/975,801

(22) Filed: May 10, 2018

(65) Prior Publication Data

US 2018/0339527 A1 Nov. 29, 2018

(30) Foreign Application Priority Data

May 26, 2017 (JP) ..... 2017-104351

(51) Int. Cl.

| | |
|---|---|
| ***B65H 29/70*** | (2006.01) |
| ***B65H 29/12*** | (2006.01) |
| ***B41J 11/00*** | (2006.01) |
| *B65H 23/34* | (2006.01) |

(52) U.S. Cl.

CPC ..... *B41J 11/0005* (2013.01); *B65H 29/125* (2013.01); *B65H 29/70* (2013.01); *B65H 23/34* (2013.01)

(58) Field of Classification Search

CPC ..... B41J 11/0005; B65H 29/125; B65H 29/70
USPC ..... 347/104
See application file for complete search history.

(56) References Cited

U.S. PATENT DOCUMENTS

2003/0145967 A1* 8/2003 Gafner ..... B65H 23/34 162/197
2009/0073211 A1* 3/2009 Imoto ..... B41J 11/0005 347/16
2016/0355029 A1* 12/2016 Kondo ..... B41J 2/01

FOREIGN PATENT DOCUMENTS

JP 2013-111785 A 6/2013

* cited by examiner

*Primary Examiner* — Huan H Tran
*Assistant Examiner* — Alexander D Shenderov
(74) *Attorney, Agent, or Firm* — Studebaker & Brackett PC

(57) ABSTRACT

A decurling device includes a first conveyance path, a second conveyance path, a first switch, a decurler, and a controller. A sheet is conveyed along the first conveyance path or the second conveyance path. The first switch switches a route of conveyance of the sheet to the first conveyance path or the second conveyance path. The sheet has a first main surface and a second main surface. The decurler is located in the second conveyance path. The decurler corrects curl of the sheet. In a situation in which a weight per unit area of the sheet is smaller than a first threshold value, the controller controls the first switch such that the sheet is conveyed along the second conveyance path.

9 Claims, 4 Drawing Sheets t1

| Type of sheet | Weight of sheet ($g/m^2$) | |
|---|---|---|
| | At least | No greater than |
| Light | 45 | 59 |
| Normal 1 | 60 | 74 |
| Normal 2 | 75 | 90 |
| Normal 3 | 91 | 105 |
| Heavy 1 | 106 | 135 |
| Heavy 2 | 136 | 163 |
| Heavy 3 | 164 | 220 |
| Heavy 4 | 221 | 256 |
| Heavy 5 | 257 | 300 |

FIG. 3 t2

| First main surface | State of sheet | First decurler | Second decurler |
|---|---|---|---|
| Low density | Does not curl | Does not pass | Does not pass |
| High density | S1 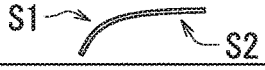 S2 | Pass | Does not pass |

FIG. 4A t3

| First main surface | Second main surface | State of sheet | First decurler | Second decurler |
|---|---|---|---|---|
| Low density | Low density | Does not curl | Does not pass | Does not pass |
| Low density | High density | S2 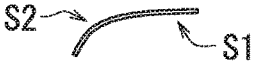 S1 | Pass | Does not pass |
| High density | Low density | S1 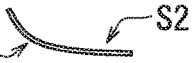 S2 | Does not pass | Pass |
| High density | High density | S2 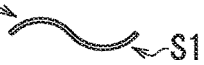 S1 | Pass | Pass |

FIG. 4B

DECURLING DEVICE AND INKJET RECORDING APPARATUS

INCORPORATION BY REFERENCE

The present application claims priority under 35 U.S.C. § 119 to Japanese Patent Application No. 2017-104351, filed on May 26, 2017. The contents of this application are incorporated herein by reference in their entirety.

BACKGROUND

The present disclosure relates to a decurling device and an inkjet recording apparatus.

There is a known inkjet recording apparatus that forms an image on a recording medium (a sheet) using a water-based ink. When an image is formed using a water-based ink, a main surface of the recording medium on which the image is formed may extend with a result that the recording medium curls. Some inkjet recording apparatus for example inhibits a lift (curl) of a recording medium by pressing the recording medium from above with a pressing member.

SUMMARY

A decurling device according to a first aspect of the present disclosure includes a first conveyance path, a second conveyance path, a first switch, a decurler, and a controller. A sheet is conveyed along the first conveyance path or the second conveyance path. The first switch switches a route of conveyance of the sheet to the first conveyance path or the second conveyance path. The sheet has a first main surface and a second main surface. The decurler is located in the second conveyance path. The decurler corrects curl of the sheet. In a situation in which a weight per unit area of the sheet is smaller than a first threshold value, the controller controls the first switch such that the sheet is conveyed along the second conveyance path.

An inkjet recording apparatus according to a second aspect of the present disclosure includes the decurling device according to the first aspect and an image forming device. The image forming device forms an image on the sheet by ejecting an ink thereto.

BRIEF DESCRIPTION OF THE DRAWINGS

FIG. 3 illustrates a first table stored in storage according to the embodiment.

FIG. 4A illustrates a second table stored in the storage according to the embodiment. FIG. 4B illustrates a third table stored in the storage according to the embodiment.

DETAILED DESCRIPTION

Figure 1:
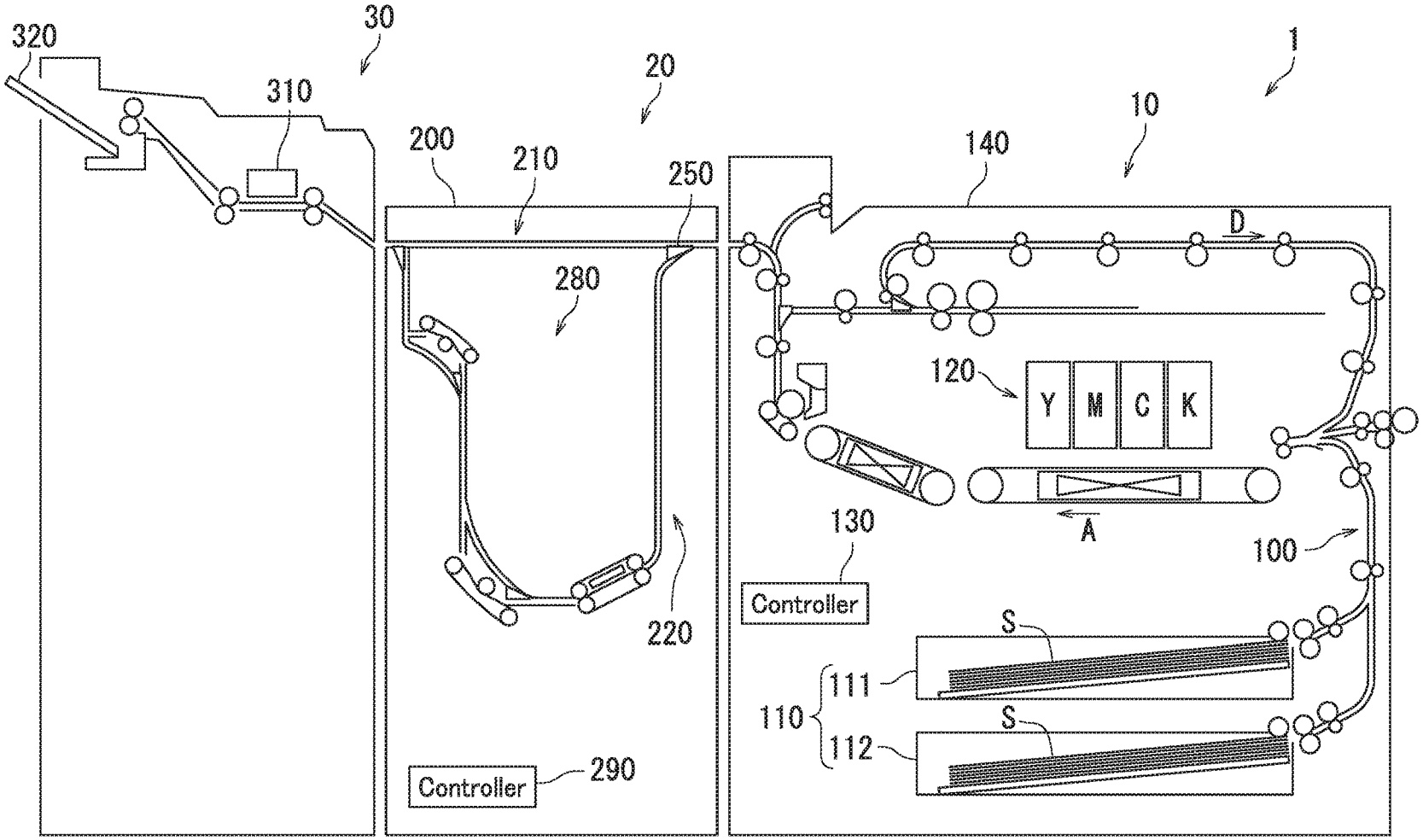
FIG. 1 is a diagram illustrating an inkjet recording apparatus according to an embodiment of the present disclosure.

The following describes an embodiment of the present disclosure with reference to the drawings. However, the present disclosure is not limited to the embodiment described below. In the drawings, elements that are the same or equivalent are labelled using the same reference signs, and explanation of which will not be repeated. Although some overlapping explanations may be omitted as appropriate, such omission does not limit the gist of the present disclosure.

The following describes an inkjet recording apparatus 1 according to an embodiment with reference to FIG. 1. FIG. 1 is a diagram illustrating the inkjet recording apparatus 1. The inkjet recording apparatus 1 includes a main body 10, a decurling device 20, and a post-printing processing device 30. The main body 10 forms an image on a sheet S. The sheet S is conveyed to the decurling device 20. In the present embodiment, a sheet S on which an image has been formed by the main body 10 is conveyed to the decurling device 20. The sheet S having been conveyed through the decurling device 20 is conveyed to the post-printing processing device 30.

The following describes the main body 10. The main body 10 includes a conveyance section 100, a cassette 110, an image forming device 120, a controller 130, and a first exit tray 140. The controller 130 is a central processing unit (CPU), for example. The controller 130 controls operation of the main body 10.

The cassette 110 accommodates sheets S. The sheets S are for example plain paper, thick paper, overhead projector (OHP) sheets, envelopes, post cards, or invoice sheets. Each sheet S has a first main surface and a second main surface. The cassette 110 includes a first cassette 111 and a second cassette 112. A sheet S accommodated in the first cassette 111 and a sheet S accommodated in the second cassette 112 differ from each other in weight per unit area thereof. In the present embodiment, the first cassette 111 accommodates a sheet S that has a weight per unit area equal to or greater than a first threshold value. The second cassette 112 accommodates a sheet S that has a weight per unit area smaller than the first threshold value. The first threshold value is set by a user in advance. The first threshold value will be described later.

The conveyance section 100 conveys each sheet S in a conveyance direction A thereof. First, the conveyance section 100 conveys the sheet S accommodated in the cassette 110 toward the image forming device 120. The image forming device 120 forms an image on the sheet S by ejecting an ink thereto.

When an image is formed only on a first main surface of the sheet S, the conveyance section 100 conveys the sheet S with the image formed thereon toward the decurling device 20 or the first exit tray 140. By contrast, when an image is to be formed on each of the first main surface and a second main surface of the sheet S, the conveyance section 100 guides the sheet S with an image formed on the first main surface thereof to the image forming device 120 again. Then, the image forming device 120 forms an image on the second main surface of the sheet S. The conveyance section 100 conveys the sheet S with the image formed on the second main surface thereof toward the decurling device 20 or the first exit tray 140.

When a specific post-printing processing is to be performed on the sheet S, the conveyance section 100 conveys the sheet S toward the decurling device 20. By contrast, when no post-printing processing is to be performed on the sheet S, the conveyance section 100 conveys the sheet S toward the first exit tray 140 for ejection of the sheet S onto the first exit tray 140.

Next, the decurling device 20 will be described. The decurling device 20 corrects (i.e., removes or decurls) curl of the sheet S. The decurling device 20 includes a first conveyance path 210, a second conveyance path 220, a first switch 250, a decurler 280, and a controller 290. The sheet S is conveyed along the first conveyance path 210 or the second conveyance path 220. The first switch 250 is located in the first conveyance path 210. The first switch 250 switches a route of conveyance of the sheet S to the first conveyance path 210 or the second conveyance path 220. The decurler 280 is located in the second conveyance path 220. The decurler 280 corrects curl of the sheet S.

The controller 290 is a CPU, for example. The controller 290 controls operation of the decurling device 20. In a situation in which the weight per unit area of the sheet S is smaller than the first threshold value, the controller 290 controls the first switch 250 such that the sheet S is conveyed along the second conveyance path 220. By contrast, in a situation in which the weight per unit area of the sheet S is equal to or greater than the first threshold value, the controller 290 controls the first switch 250 such that the sheet S is conveyed along the first conveyance path 210. That is, the sheet S accommodated in the first cassette 111 is conveyed along the first conveyance path 210 in the present embodiment. The sheet S accommodated in the second cassette 112 is conveyed along the second conveyance path 220 in the present embodiment.

Next, the post-printing processing device 30 will be described. The post-printing processing device 30 performs a specific post-printing processing on the sheet S. The specific post-printing processing is a punching processing, for example. The punching processing is a processing by which a punch hole is formed through the sheet S. The post-printing processing device 30 includes a punching section 310 and a second exit tray 320. The punching section 310 performs the punching processing on the sheet S having been conveyed thereto. The sheet S subjected to the punching processing is ejected onto the second exit tray 320.

As described above with reference to FIG. 1, in a situation in which the weight per unit area of the sheet S is smaller than the first threshold value, the first switch 250 is controlled such that the sheet S is conveyed along the second conveyance path 220 in the present embodiment. Therefore, curl of the sheet S is corrected in a situation in which the weight per unit area of the sheet S is smaller than the first threshold value. Thus, curl correction is performed on the sheet S according to the weight per unit area of the sheet S.

In a situation in which the weight per unit area of the sheet S is equal to or greater than the first threshold value, the first switch 250 is controlled such that the sheet S is conveyed along the first conveyance path 210 in the present embodiment. Therefore, curl correction is not performed on the sheet S in a situation in which the weight per unit area of the sheet S is equal to or greater than the first threshold value. Thus, it can be prevented that curl correction is unnecessarily performed on the sheet S.

Further, the sheet S having been conveyed through the decurling device 20 is conveyed to the post-printing processing device 30 in the present embodiment. Therefore, curl correction has been performed on the sheet S conveyed to the post-printing processing device 30. As a result, the post-printing processing can be performed more accurately on the sheet S by the post-printing processing device 30.

Figure 2:
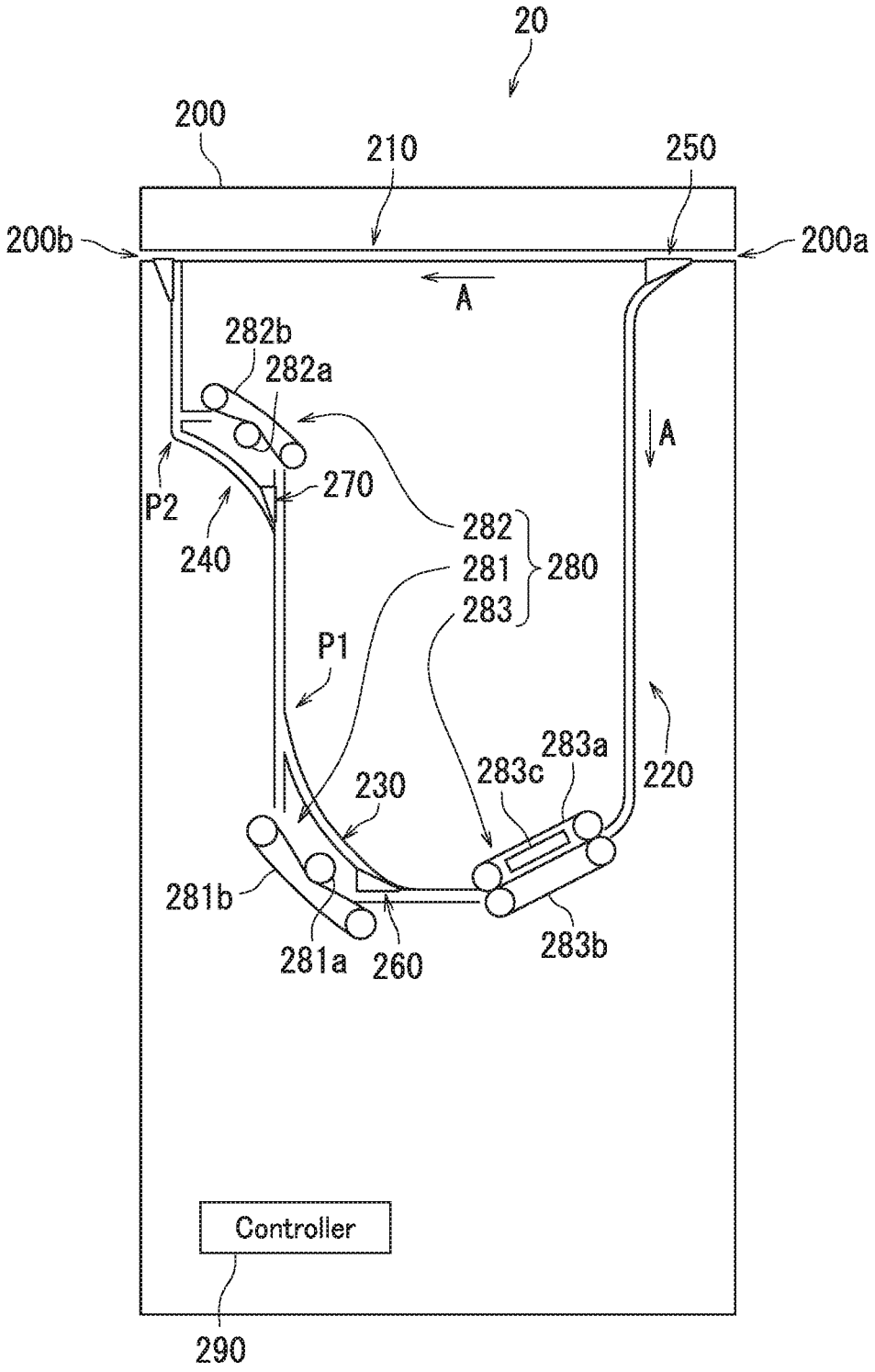
FIG. 2 is a diagram illustrating a decurling device according to the embodiment.

Next, the decurling device 20 will be described in detail with reference to FIG. 2. FIG. 2 illustrates the decurling device 20. The decurling device 20 further includes a housing 200, a third conveyance path 230, a fourth conveyance path 240, a second switch 260, and a third switch 270.

The housing 200 has an insertion port 200*a* and an exit port 200*b*. The sheet S having been conveyed from the main body 10 is inserted into the insertion port 200*a* (see FIG. 1). The sheet S having been conveyed through the decurling device 20 is ejected from the exit port 200*b* toward the post-printing processing device 30 (see FIG. 1). The first conveyance path 210 and the second conveyance path 220 both extend from the insertion port 200*a* to the exit port 200*b*.

The decurler 280 includes a first decurler 281, a second decurler 282, and a heater 283. The heater 283 is located upstream of the first decurler 281 in the conveyance direction A of the sheet S. The first decurler 281 is located between the heater 283 and the second decurler 282 in the conveyance direction A of the sheet S. The second decurler 282 is located downstream of the first decurler 281 in the conveyance direction A of the sheet S. The heater 283 heats the sheet S. The first decurler 281 and the second decurler 282 each press the sheet S.

The second switch 260 and the third switch 270 are both located in the second conveyance path 220. Specifically, the second switch 260 is located upstream of the first decurler 281 in the conveyance direction A of the sheet S. The third switch 270 is located downstream of the first decurler 281 and upstream of the second decurler 282 in the conveyance direction A of the sheet S.

The third conveyance path 230 and the fourth conveyance path 240 each are a path along which the sheet S is conveyed. The third conveyance path 230 extends from the second switch 260 to a first position P1. The first position P1 is located downstream of the first decurler 281 and upstream of the third switch 270 in the conveyance direction A of the sheet S. The fourth conveyance path 240 extends from the third switch 270 to a second position P2. The second position P2 is located downstream of the second decurler 282 in the conveyance direction A of the sheet S.

The second switch 260 switches the route of conveyance of the sheet S to the second conveyance path 220 or the third conveyance path 230. The third switch 270 switches the route of conveyance of the sheet S to the second conveyance path 220 or the fourth conveyance path 240.

Description will be continued about details of the heater 283, the first decurler 281, and the second decurler 282 with reference to FIG. 2. The heater 283 includes a third belt 283*a*, a fourth belt 283*b*, and a heat source 283*c*. The third belt 283*a* and the fourth belt 283*b* are each an endless belt supported in a circulatable manner. The third belt 283*a* and the fourth belt 283*b* convey the sheet S by circulation with the sheet S sandwiched therebetween. The heat source 283*c* is located inside the third belt 283*a*. The heat source 283*c* is a member capable of generating heat. The heat source 283*c* is a filament, for example. The third belt 283*a* and the fourth belt 283*b* convey the sheet S by circulation with the sheet S sandwiched therebetween. In the above configuration, the sheet S is conveyed by the heater 283 while being heated.

The first decurler 281 includes a first roller 281*a* and a first belt 281*b*. The first roller 281*a* is supported in a rotatable manner, and the first belt 281*b* is supported in a circulatable manner. The first belt 281*b* is an endless belt. The first roller 281*a* and the first belt 281*b* convey the sheet S by rotation or circulation with the sheet S sandwiched therebetween. In the above configuration, in a situation in which an image is formed only on the first main surface of the sheet S, curl of the sheet S in a direction from the second main surface toward the first main surface thereof is corrected by the first decurler 281. In a situation in which an image is formed on each of the first main surface and the second main surface of the sheet S, curl of the sheet S in a direction from the first main surface toward the second main surface is corrected by the first decurler 281. Note that curl of the sheet S in the direction from the second main surface toward the first main surface thereof refers to convex curl of the sheet S as seen from the second main surface thereof.

Curl of the sheet S in the direction from the first main surface toward the second main surface thereof refers to convex curl of the sheet S as seen from the first main surface thereof.

The second decurler 282 includes a second roller 282*a* and a second belt 282*b*. The second roller 282*a* is supported in a rotatable manner, and the second belt 282*b* is supported in a circulatable manner. The second belt 282*b* is an endless belt. The second roller 282*a* and the second belt 282*b* convey the sheet S by rotation or circulation with the sheet S sandwiched therebetween. In the above configuration, in a situation in which an image is formed on each of the first main surface and the second main surface of the sheet S, curl of the sheet S in a direction from the second main surface toward the first main surface is corrected by the second decurler 282.

As described above with reference to FIG. 2, the heater 283 heats the sheet S in the present embodiment. Through the above, moisture of ink attached to the sheet S can be evaporated to promote drying of the ink. As a result, curl correction can be more efficiently performed on the sheet S by the first decurler 281 and the second decurler 282.

Further, the first roller 281*a* and the first belt 281*b* convey the sheet S by rotation or circulation with the sheet S sandwiched therebetween in the present embodiment. In the above configuration, part of the sheet S sandwiched between the first roller 281*a* and the first belt 281*b* is flattened. Through the above, curl of the sheet S is corrected.

Further, the second roller 282*a* and the second belt 282*b* convey the sheet S by rotation or circulation with the sheet S sandwiched therebetween in the present embodiment. In the above configuration, part of the sheet S sandwiched between the second roller 282*a* and the second belt 282*b* is flattened. Through the above, curl of the sheet S is corrected.

Further, in a situation in which an image is formed only on the first main surface of the sheet S, curl of the sheet S in a direction from the second main surface toward the first main surface is corrected in the present embodiment. Thus, curl correction of the sheet S can be performed according to the direction of the curl of the sheet S. As a result, the sheet S can be made flatter.

Further, in a situation in which an image is formed on each of the first main surface and the second main surface of the sheet S, curl of the sheet S in a direction from the first main surface toward the second main surface and curl of the sheet S in a direction from the second main surface toward the first main surface are corrected in the present embodiment. Thus, curl correction of the sheet S can be performed according to the direction of the curl of the sheet S. As a result, the sheet S can be made flatter.

The following describes a first table t1 that shows correspondence between a type of the sheet S and the weight per unit area of the sheet S with reference to FIG. 3. FIG. 3 illustrates the first table t1 that shows correspondence between a type of the sheet S and the weight per unit area of the sheet S. The controller 290 stores the first table t1 therein. As illustrated in FIG. 3, a range of the weight per unit area is stored for each type of the sheet S in the first table t1.

For example, in a situation in which the type of the sheet S is "Light", the weight per unit area of the sheet S is within a range of from at least 45 $g/m^2$ and to greater than 59 $g/m^2$. In the present embodiment, the first threshold value is 106 $g/m^2$. Accordingly, in a situation in which the type of the sheet S is any of "Light" to "Normal 3", the sheet S is conveyed along the second conveyance path 220. In a situation in which the type of the sheet S is any of "Heavy 1" to "Heavy 5", the sheet S is conveyed along the first conveyance path 210.

The following describes conveyance control performed by the controller 290 with reference to FIGS. 2, 4A, and 4B. In the following description, a density of an image lower than a second threshold value will be referred to as a low density. A density of an image equal to or higher than the second threshold value will be referred to as a high density. In the present embodiment, the second threshold value is used for determining whether or not the sheet S extends. In a situation in which the density of an image formed on the sheet S is lower than the second threshold value, i.e., the image has a low density, the sheet S does not extend and curl. By contrast, in a situation in which the density of an image formed on the sheet S is equal to or higher than the second threshold value. i.e., the image has a high density, the sheet S extends and curls.

First, the following describes with reference to FIG. 4A conveyance control performed when an image is formed only on a first main surface S1 of the sheet S. FIG. 4A illustrates a second table t2 used for the conveyance control performed when an image is formed only on the first main surface S1 of the sheet S. The controller 290 stores the second table t2 therein. The controller 290 performs the conveyance control referring to the second table t2.

As indicated in FIG. 4A, in a situation in which the image formed on the first main surface S1 of the sheet S has a low density, the sheet S does not curl. Therefore, in a situation in which the image formed on the first main surface S1 of the sheet S has a low density, the controller 290 controls the second switch 260 such that the sheet S is conveyed along the third conveyance path 230 and controls the third switch 270 such that the sheet S is conveyed along the fourth conveyance path 240. As a result, the sheet S does not pass through the first decurler 281 and the second decurler 282. Therefore, the sheet S is prevented from being unnecessarily curled.

In a situation in which the image formed on the first main surface S1 of the sheet S has a high density, the first main surface S1 extends and the sheet S curls. Therefore, in a situation in which the image formed on the first main surface S1 of the sheet S has a high density, the controller 290 controls the second switch 260 such that the sheet S is conveyed along the second conveyance path 220 and controls the third switch 270 such that the sheet S is conveyed along the fourth conveyance path 240. As a result, the sheet S passes through the first decurler 281 and does not pass through the second decurler 282. Through the above, curl of the sheet S in a direction from a second main surface S2 toward the first main surface S1 thereof can be corrected.

The following describes with reference to FIG. 4B conveyance control performed when an image is formed on each of the first main surface S1 and the second main surface S2 of the sheet S. FIG. 4B illustrates a third table t3 used for the conveyance control performed when an image is formed on each of the first main surface S1 and the second main surface S2 of the sheet S. The controller 290 stores the third table t3 therein. The controller 290 performs the conveyance control referring to the third table t3.

As indicated in FIG. 4B, in a situation in which the image formed on the first main surface S1 and the image formed on the second main surface S2 each have a low density, the sheet S does not curl. Therefore, in a situation in which the image formed on the first main surface S1 and the image formed on the second main surface S2 each have a low density, the controller 290 controls the second switch 260 such that the sheet S is conveyed along the third conveyance path 230 and controls the third switch 270 such that the sheet S is conveyed along the fourth conveyance path 240. As a result, the sheet S does not pass through the first decurler 281 and the second decurler 282. Therefore, the sheet S is prevented from being unnecessarily curled.

In a situation in which the image formed on the first main surface S1 has a low density and the image formed on the second main surface S2 has a high density, the second main surface S2 extends and the sheet S curls. Therefore, in a situation in which the image formed on the first main surface S1 has a low density and the image formed on the second main surface S2 has a high density the controller 290 controls the second switch 260 such that the sheet S is conveyed along the second conveyance path 220 and controls the third switch 270 such that the sheet S is conveyed along the fourth conveyance path 240. As a result, the sheet S passes through the first decurler 281 and does not pass through the second decurler 282. Through the above, curl of the sheet S in a direction from the first main surface S1 toward the second main surface S2 thereof can be corrected.

In a situation in which the image formed on the first main surface S1 has a high density and the image formed on the second main surface S2 has a low density, the first main surface S1 extends and the sheet S curls. Therefore, in a situation in which the image formed on the first main surface S1 has a high density and the image formed on the second main surface S2 has a low density, the controller 290 controls the second switch 260 such that the sheet S is conveyed along the third conveyance path 230 and controls the third switch 270 such that the sheet S is conveyed along the second conveyance path 220. As a result, the sheet S does not pass through the first decurler 281 and passes through the second decurler 282. Through the above, curl of the sheet S in a direction from the second main surface S2 toward the first main surface S1 thereof can be corrected.

In a situation in which the image formed on the first main surface S1 and the image formed on the second main surface S2 each have a high density, the first main surface S1 and the second main surface S2 both extend and the sheet S curls. Therefore, in a situation in which the image formed on the first main surface S1 and the image formed on the second main surface S2 each have a high density, the controller 290 controls the second switch 260 and the third switch 270 such that the sheet S is continuously conveyed along the second conveyance path 220. As a result, the sheet S passes through the first decurler 281 and the second decurler 282. Through the above, curl of the sheet S in a direction from the second main surface S2 toward the first main surface S1 thereof and curl of the sheet S in a direction from the first main surface S1 toward the second main surface S2 can be both corrected.

As described above with reference to FIGS. 1 to 4B, in a situation in which an image having a low density is formed only on the first main surface S1 of the sheet S, the second switch 260 is controlled such that the sheet S is conveyed along the third conveyance path 230 in the present embodiment. Thus, curl correction of the sheet S can be performed according to the presence or absence of curl of the sheet S. Therefore, the sheet S is prevented from being unnecessarily curled.

In a situation in which an image having a low density is formed on each of the first main surface S1 and the second main surface S2 of the sheet S, the second switch 260 and the third switch 270 are controlled such that the sheet S is conveyed along the third conveyance path 230 and the fourth conveyance path 240 in the present embodiment. Thus, curl correction of the sheet S can be performed according to the presence or absence of curl of the sheet. As a result, the sheet S can be made flatter.

Through the above, the embodiment of the present disclosure has been described with reference to the drawings (FIGS. 1 to 4B). However, the present disclosure is not limited to the above embodiment and may be practiced in various manners (for example, as described below in (1) to (6)) within a scope not departing from the gist of the present disclosure. The drawings schematically illustrate elements of configuration in order to facilitate understanding. Properties such as thickness and length, and the number of the elements of configuration illustrated in the drawings may differ from actual properties and number thereof in order to facilitate preparation of the drawings. Also, shape, dimensions, and the like of elements of configuration described in the above embodiment are merely examples and not intended to be specific limitations. Various alterations may be made within a scope not substantially departing from the effects of the present disclosure.

(1) As described with reference to FIGS. 4A and 4B, in a situation in which the sheet S is not curled, the controller 290 controls the second switch 260 and the third switch 270 such that the sheet S does not pass through the first decurler 281 and the second decurler 282. However, in a situation in which the sheet S is not curled, the controller 290 may control the first switch 250 such that the sheet S is conveyed along the first conveyance path 210 even when the weight per unit area of the sheet S is equal to or greater than the first threshold value. In the above configuration, the sheet S does not pass through the decurler 280. Accordingly, the sheet S does not pass through the heater 283. As a result, the sheet S is prevented from being unnecessarily heated.

(2) As described with reference to FIG. 1, the post-printing processing device 30 performs the punching processing as the specific post-printing processing. However, stapling processing may be performed as the specific post-printing processing instead of the punching processing as long as the post-printing processing device 30 performs the specific post-printing processing on a sheet S with an image formed thereon. The stapling processing is processing by which a stack of sheets S is bound using a binding piece such as a staple. In this configuration, the post-printing processing device 30 includes a stapling section. Alternatively, the post-printing processing device 30 may perform both the punching processing and the stapling processing on the sheet S with an image formed thereon. In this configuration, the post-printing processing device 30 includes the punching section 310 and the stapling section.

(3) As described with reference to FIG. 1, the controller 290 controls the first switch 250 such that a sheet S accommodated in the first cassette 111 is conveyed along the first conveyance path 210 and a sheet S accommodated in the second cassette 112 is conveyed along the second conveyance path 220. However, the controller 290 may control the first switch 250 according to the type of the sheet S designated by a user as long as the first switch 250 is controlled according to the weight per unit area of the sheet S. For example, in a situation in which the user designates "Light" as the type of the sheet S (see FIG. 3), the controller 290 controls the first switch 250 such that the sheet S is conveyed along the second conveyance path 220.

(4) As described with reference to FIG. 2, the controller 290 controls the second switch 260 and the third switch 270 according to the density of an image formed on the sheet S. However, the controller 290 may control the second switch 260 and the third switch 270 on a job-by-job basis as long as the second switch 260 and the third switch 270 are controlled according to the density of an image formed on the sheet S. Alternatively, the second switch 260 and the third switch 270 may be controlled on a sheet-by-sheet basis in execution of a single job.

(5) As described with reference to FIG. 1, the decurler 280 is located within the decurling device 20. However, the decurler 280 may be located within the main body 10 as long as the decurler 280 corrects curl of the sheet S. Alternatively, the decurler 280 may be located within the post-printing processing device 30.

(6) As described with reference to FIG. 1, a sheet S with an image formed thereon by the image forming device 120 with ink is conveyed to the decurling device 20. However, a sheet S to which a liquid other than ink has been applied may be conveyed to the decurling device 20 as long as the decurling device 20 corrects curl of the sheet S. The decurling device 20 corrects curl of the sheet S wetted with the liquid.

What is claimed is:

1. A decurling device comprising:

a first conveyance path along which a sheet is conveyed;

a second conveyance path along which the sheet is conveyed;

a third conveyance path along which the sheet is conveyed;

a fourth conveyance path along which the sheet is conveyed;

a first switch configured to switch a route of conveyance of the sheet to the first conveyance path or the second conveyance path;

a second switch;

a third switch;

a decurler located in the second conveyance path; and a controller, wherein the sheet has a first main surface and a second main surface, the decurler corrects curl of the sheet, and in a situation in which a weight per unit area of the sheet is smaller than a first threshold value, the controller controls the first switch such that the sheet is conveyed along the second conveyance path, the decurler includes:

a first decurler; and a second decurler located downstream of the first decurler in a conveyance direction of the sheet, curl of the sheet in a direction from the first main surface toward the second main surface thereof is corrected by the first decurler, curl of the sheet in a direction from the second main surface toward the first main surface thereof is corrected by the second decurler, the second switch is located upstream of the first decurler in the conveyance direction of the sheet, the third switch is located downstream of the first decurler and upstream of the second decurler in the conveyance direction of the sheet, the third conveyance path extends from the second switch to a first position, the fourth conveyance path extends from the third switch to a second position, the first position is located downstream of the first decurler and upstream of the third switch in the conveyance direction of the sheet, the second position is located downstream of the second decurler in the conveyance direction of the sheet, the second switch switches the route of conveyance of the sheet to the second conveyance path or the third conveyance path, and the third switch switches the route of conveyance of the sheet to the second conveyance path or the fourth conveyance path.

2. The decurling device according to claim 1, wherein in a situation in which the weight per unit area of the sheet is equal to or greater than the first threshold value, the controller controls the first switch such that the sheet is conveyed along the first conveyance path.

3. The decurling device according to claim 1, wherein in a situation in which an image having a density lower than a second threshold value is formed on the second main surface of the sheet, the controller controls the second switch such that the sheet is conveyed along the third conveyance path, and in a situation in which an image having a density lower than the second threshold value is formed on the first main surface of the sheet, the controller controls the third switch such that the sheet is conveyed along the fourth conveyance path.

4. The decurling device according to claim 1, wherein in a situation in which an image having a density lower than a second threshold value is formed on the first main surface of the sheet, the controller controls the second switch such that the sheet is conveyed along the third conveyance path.

5. The decurling device according to claim 1, wherein the decurler further includes a heater located upstream of the first decurler in the conveyance direction of the sheet, and the heater heats the sheet.

6. The decurling device according to claim 5, wherein the heater includes:

a third belt supported in a circulatable manner;

a fourth belt supported in a circulatable manner; and a heat source located inside the third belt, and the third belt and the fourth belt convey the sheet by circulation with the sheet sandwiched therebetween.

7. The decurling device according to claim 1, wherein the first decurler includes:

a first roller supported in a rotatable manner; and a first belt supported in a circulatable manner, and the first roller and the first belt convey the sheet by rotation or circulation with the sheet sandwiched therebetween.

8. The decurling device according to claim 1, wherein the second decurler includes:

a second roller supported in a rotatable manner; and a second belt supported in a circulatable manner, and the second roller and the second belt convey the sheet by rotation or circulation with the sheet sandwiched therebetween.

9. An inkjet recording apparatus comprising:

the decurling device according to claim 1; and an image forming device configured to form an image on the sheet by ejecting an ink thereto.

* * * * *